US006719487B2

(12) United States Patent
Yukimoto et al.

(10) Patent No.: US 6,719,487 B2
(45) Date of Patent: Apr. 13, 2004

(54) STRUCTURAL UNIT FOR CONSTRUCTION, CONSTRUCTION OF SAID STRUCTURAL UNITS, AND METHOD FOR THE PREPARATION OF SAID STRUCTURAL UNITS AND SAID CONSTRUCTION

(75) Inventors: Isao Yukimoto, Hino (JP); Kiyonori Hasegawa, Tachikawa (JP)

(73) Assignee: Kankyo Kogaku Co., Ltd., Tokyo (JP)

( * ) Notice: Subject to any disclaimer, the term of this patent is extended or adjusted under 35 U.S.C. 154(b) by 0 days.

(21) Appl. No.: 10/014,819

(22) Filed: Dec. 14, 2001

(65) Prior Publication Data

US 2002/0108348 A1 Aug. 15, 2002

(30) Foreign Application Priority Data

Dec. 20, 2000 (JP) ..... 2000-386596

(51) Int. Cl.[7] ..... E02B 3/12; E21D 21/00; E02D 17/00

(52) U.S. Cl. ..... 405/16; 405/262; 405/284; 52/604

(58) Field of Search ..... 405/259.1, 262, 405/284, 16, 15, 17; 52/604

(56) References Cited

U.S. PATENT DOCUMENTS 3,421,326 A 1/1969 Vidal
4,124,983 A * 11/1978 Weatherby ..... 405/259.5
4,302,131 A 11/1981 Brown
4,490,074 A 12/1984 Chaiko
4,834,584 A 5/1989 Hilfiker
5,138,796 A * 8/1992 Grainger ..... 49/238
5,468,098 A * 11/1995 Babcock ..... 405/262
5,533,839 A * 7/1996 Shimada ..... 405/284
6,238,144 B1 * 5/2001 Babcock ..... 405/284

FOREIGN PATENT DOCUMENTS

CH 603919 A * 8/1978 ..... E02D/5/80
DE 24 13 526 5/1975
JP 2000-303429 10/2000

* cited by examiner

*Primary Examiner*—Heather Shackelford
*Assistant Examiner*—Lisa M Saldano
(74) *Attorney, Agent, or Firm*—Morrison & Foerster LLP

(57) ABSTRACT

The structuring unit is composed of a wall surface member for the construction with a mounting cavity formed therein, such as a stone, and an anchor mounted on the wall surface member for the construction through the mounting cavity thereof. The anchor is provided with a resistance-increasing member at the opposite side thereof. The anchor is composed of a linear member extending over the full length of the anchor, a protective layer for protecting the linear member from physical damages, and a flexible layer for preventing water or the like from penetrating into a gap between the linear member and the protective layer. The construction such as a revetment or the like is built by laying plural rows of the structural units over one another and embedding the plural rows of the structural units with filling materials.

14 Claims, 11 Drawing Sheets

STRUCTURAL UNIT FOR CONSTRUCTION, CONSTRUCTION OF SAID STRUCTURAL UNITS, AND METHOD FOR THE PREPARATION OF SAID STRUCTURAL UNITS AND SAID CONSTRUCTION

CROSS-REFERENCE TO RELATING APPLICATION

The entire disclosure of Japanese Patent Application No. 2000-386596 filed on Dec. 20, 2000 including specification, claims and summary is incorporated by reference in its entirety.

BACKGROUND OF THE INVENTION

1. Field of the Invention

The present invention relates to a structural unit for a construction, a construction made from the structural units, and a method for the production of the structural units for the construction as well as for the production of the construction.

2. Description of the Related Art

In a conventional way of building a construction including a revetment, a retaining wall or the like, structural units are used for such a construction. The structural unit may be prepared by mounting an one end portion of an anchor for use with a wall surface member on a box-shaped wall surface member for the construction or a natural stone and providing the opposite end portion thereof with a resistance-increasing member for increasing resistance. The construction is built from a number of the structural units by laying a row of the structural units on another row of the structural units so as to lay each anchor for use with the structural member in a generally horizontal arrangement, filling a space formed by the structural units with filling materials, and embedding the space with them. This construction can provide a rigid structure having a strong resistance to ground pressure and water flow etc. and offer a living space for aquatic animals and plants.

For the construction with the structural units laid in plural rows in the manner as described above, however, the anchors and the resistance-increasing members of the structural units are embedded in the filling materials such as natural stones, cracked stones, cobbled stones, or the like so that there is the risk that the anchors and the resistance-increasing members may be damaged by the filling materials upon filling a space formed by the anchors and the resistance-increasing members of the structural units with the filling materials. Further, there may be the risk that rain water or the like penetrates into the filling materials and, moreover, the anchor is brought into contact with water penetrated therein or the like (including materials dissolved during penetration).

SUMMARY OF THE INVENTION

With the above situation taken into account, the present invention has been completed and it has the first object in an aspect to provide a structural unit for a construction that can protect an anchor for use with a wall surface member for the construction from being damaged upon embedding or from rusting.

In another aspect, the present invention has the second object to provide a construction built from the structural units therefor.

In a further aspect, the present invention has the third object to provide a method for the production of the structural unit for the construction.

In order to achieve the object as described above, the present invention (as will be described in claim 1) is directed to a structural unit for a construction which comprises a wall surface member for the structural unit, an anchor for use with the wall surface member, and a resistance-increasing member, a one end portion of the anchor for use with the wall surface member being mounted on the wall surface member for use with said construction so as to become apart from the other end portion of the anchor therefor and the resistance-increasing member being mounted on the other end portion of the anchor therefor; wherein the anchor for use with the wall surface member therefor includes a protective layer disposed at an outer periphery of the anchor therefor. The preferred modes of the invention as described in claim 1 below are as described in claims 2 to 8 below.

In order to achieve the second object as described above, the present invention (as will be described in claim 9) is configured by a construction comprising a plurality of structural units for the construction, each of the structural units including a resistance-increasing member for increasing a resistance, mounted at a one end portion of an anchor for use with a wall surface member for the construction, the anchor being in turn mounted at another end portion thereof on the wall surface member therefor; the plurality of the structural units therefor being laid on one another in the construction so as to be disposed adjacent to one another; and the anchor therefor and the resistance-increasing member being embedded with a filling material in the structural unit for the construction; wherein the anchor for use with the wall surface member is provided with a protective layer at a periphery thereof. The preferred modes of the invention as described in claim 9 below are as described in claim 10 below.

In order to achieve the third object as described above, the present invention (as described in claim 11) is directed to a method for the production of the structural unit for the construction, comprising: the step of preparing the wall surface member for the construction with a mounting cavity, a linear member having the one end portion functioning as a mounting end portion for mounting the wall surface member therefor and having the other end portion with the resistance-increasing member for increasing resistance, and a protective tube member in a cylindrical form; the step of inserting the linear member into the protective tube member from the one end of the linear member and projecting a portion of the linear member from the protective tube member; and the step of filling the mounting cavity of the wall surface member for the construction with adhesive and inserting the linear member protruded from the protective tube member into the mounting cavity thereof.

In achieve the third object as described above, the present invention (as will be described in claim 12) is further directed to a method for the production of the structural unit for the construction, which comprises the step of preparing the wall surface member for the construction with the mounting cavity, the linear member having the one end portion functioning as the mounting end portion for mounting the wall surface member therefor and having the other end portion with the resistance-increasing member for increasing resistance, the protective tube member in a cylindrical form, and a flexible tube member in a cylindrical form; the step of inserting the linear member into the protective tube member and the flexible tube member from a one end of the linear member and projecting a portion of the linear member from the flexible tube member; and the step of filling the mounting cavity of the wall surface member for the construction with adhesive and inserting the linear member protruded from the flexible tube member into the mounting cavity thereof.

The present invention having the first to third objects as described above can offer the features and advantages as will be described above.

Therefore, the present invention as described in claim 1 provides a structural unit for a construction having the protective layer at the outer periphery of the anchor for use with the wall surface member, which can receive and withstand an external force from the filling material upon filling with the filling material and which can protect water penetrating into the filling material or the like from coming into contact with the anchor therefor. This arrangement of the structural unit can prevent the anchor for use with the wall surface member from being damaged at the time of embedding and the anchor therefor from rusting during usage.

In accordance with the present invention as described in claim 2, the protective layer of the anchor comprises a first protective layer and a second protective layer and the first and second protective layers. The first protective layer can ensure the property of preventing the penetration of water and the second protective layer disposed at the outer peripheral side of the first protective layer can receive and withstand an external force from the filling materials upon filling the anchor with the filling materials. This configuration of the protective layer allows the first and second protective layers to individually and separately compete with the external force from the filling materials and the penetration of water, thereby providing more effective performance. Further, as the second protective layer having the stronger resistance to the external force is located at the outer peripheral side of the first protective layer, the first protective layer can be protected by the second protective layer from the external force applied by the filling materials upon filling the filling materials. Therefore, the first protective layer can be prevent from rusting by the penetration of water or the like for a long period of time after the anchor for use with the wall surface member has been embedded into the filling materials.

In accordance with the present invention as described in claim 3, the first protective layer is composed of a resin-covered layer made of a high-density polyethylene resin and the second protective layer is composed of an iron pipe. Therefore, the erosion of the anchor for use with the wall surface member can be prevented effectively by the resin-covered layer made of such a high-density polyethylene resin having superior properties of resistance to water, resistance to chemicals (acids and alkalis) and durability (thermal resistance). On the other hand, the second protective layer is made from such an iron pipe that can highly resist the external force from the filling material. Therefore, the actions and effects as achieved by the invention as described in claim 2 can be gained because the first protective layer (as the resin-covered layer made of the high-density polyethylene resin) can prevent the damages at the time of filling the anchor for use with the wall surface member with the filling materials;

Further, in accordance with the present invention as described in claim 4, the flexible layer is disposed in a series, together with the protective layer, at the outer periphery of the anchor for use with the wall surface member for the construction and interposed between the resistance-increasing member and the wall surface member therefor The flexible layer is located at the side of the wall surface member for the construction and disposed in abutment with the wall surface member therefor so that it can separate the end face of the protective layer from the wall surface member therefor and at the same time that the flexibility at that portion can be enhanced within the scope of elasticity. Therefore, the flexible layer allows the wall surface member for the construction to yield at a radius of curvature larger than when no flexible layer is disposed, even if a load is concentrated onto the anchor for use with the wall surface member therefor at the time of filling with the filling material. Thus, this configuration is less subject to damages such as breakage of the anchor therefor at the location nearby the wall surface member for the construction upon filling with the filling materials.

In accordance with the present invention as described in claim 5, the flexible layer is disposed in a distance extending from the wall surface member for the construction shorter in length than the diameter of the filling material for use in embedding the anchor therein, so that the filling materials strike into the wall surface member for the construction and are sprung back therefrom even if the filling materials would come into collision with the flexible layer upon filling with the filling materials. Therefore, even if the filling materials would strike into the flexible layer, the anchor for use with the wall surface member for the construction can be protected from damages due to the collision.

In accordance with the present invention as described in claim 6 on the basis of the invention as described in claim 5, the protective layer is composed of the first protective layer having the property of preventing the penetration of water and the second protective layer capable of withstanding the external force, disposed at the outer peripheral side of the first protective layer, and the first and second protective layers are clamped in a series by the resistance-increasing member and the wall surface member for the construction. Therefore, this embodiment of the present invention can achieve the actions and effects as achieved by the invention as claimed in claims 2 and 5.

The present invention as described in claim 7 provides the resistance-increasing member comprising a stopper panel and a movement-regulating section. The stopper panel is made of a synthetic resin and inserted into the outer periphery of the first protective layer so as to be movable. The movement-regulating section is disposed at the opposite end portion of the anchor for use with the wall surface member so as to regulate the outward movement of the stopper panel from the opposite end portion of the anchor therefor. The second protective layer is disposed at the side of the wall surface member for the construction from the stopper panel, and the stopper panel is provided with an accommodation section for accommodating and enclosing the periphery of the movement-regulating section with the anchor therefor centered. Therefore, the stopper panel itself can be protected from corrosion or the like by its material (synthetic resin), and the first and second protective layers are also protected from corrosion or the like on the side of the wall surface member from the stopper panel. On the other hand, the movement-regulating section can be protected from the external force by the accommodation section of the stopper panel. Therefore, the first protective layer and the accommodation section of the stopper panel can prevent the movement-regulating section from being damaged and corroded.

In accordance with the present invention as described in claim 8, the wall surface member for the construction is provided with a mounting cavity in which the anchor for use with the wall surface member therefor is to be mounted. The mounting cavity is beveled at its opening edge portion so that the beveled opening edge portion of the mounting cavity can control the concentration of stress onto the anchor therefor at the location in the vicinity of the wall surface member for the construction even if the greatest bending moment would act thereon.

The present invention as described in claim 9 builds a construction from the structural units for the construction as described in claim 1. In the construction, a plurality of the structural units for the construction are used which are each provided with the resistance-increasing member for increasing the resistance at the one end portion of the anchor for use with the wall surface member for the construction while the other end portion of the anchor therefor is mounted on the wall surface member therefor. In the construction, the wall surface members therefor are disposed adjacent to one another in a superimposed state and the anchors therefor and the resistance-increasing members are embedded in the filling materials. Moreover, the anchor for use with the wall surface member for the construction is provided with the protective layer at the outer periphery thereof.

In accordance with the present invention as described in claim 10, the flexible layer is disposed in a series, together with the protective layer, at the outer periphery of the anchor for use with the wall surface member for the construction in the structural unit for the construction, while the flexible member is clamped or interposed between the resistance-increasing layer and the wall surface member for the construction. Further, the flexible layer is located at the side of the wall surface member for the construction and disposed in abutment with the wall surface member therefor. Therefore, the construction can be built from the structural units for use in building the construction as described in claim 4.

The present invention as described in claim 11 provides a method for the production of the structural unit for the construction, comprising the step of preparing the wall surface member for the construction with the mounting cavity, a linear member having the one end portion functioning as a mounting end portion for mounting the wall surface member therefor and having the other end portion with the resistance-increasing member for increasing resistance, and the protective tube member in a cylindrical form; the step of inserting the linear member into the protective tube member from the one end of the linear member and projecting a portion of the linear member from the protective tube member; and the step of filling the mounting cavity of the wall surface member therefor with adhesive and inserting the portion of the linear member protruded from the protective tube member into the mounting cavity thereof. Therefore, the structural unit for use with the construction can be provided with the protective layer at the outer periphery of the anchor for use with the wall surface member on the basis of the protective tube member, so that the structural unit therefor as described in claim 1 can be prepared with ease.

In accordance with the present invention as described in claim 12, there is provided a method for the production of the structural unit for the construction, which includes the step of preparing the wall surface member for the construction with the mounting cavity, the linear member having the one end portion functioning as a mounting end portion for mounting the wall surface member therefor and having the other end portion with the resistance-increasing member for increasing resistance, the protective tube member in a cylindrical form, and the flexible tube member; the step of inserting the linear member into the protective tube member and the flexible tube member from the one end of the linear member and projecting a portion of the linear member from the flexible tube member; and the step of filling the mounting cavity of the wall surface member therefor with adhesive and inserting the linear member protruded from the flexible tube member into the mounting cavity thereof. Therefore, the structural unit for use with the construction can be provided with the protective layer and the flexible layer at the outer periphery of the anchor for use with the wall surface member on the basis of the protective tube member and the flexible tube member, respectively, so that the structural unit therefor as described in claim 4 can be prepared with ease.

Other objects, features and advantages according to the present invention will become apparent in the course of the following specification with reference to the accompanying drawings.

BRIEF DESCRIPTION OF THE ACCOMPANYING DRAWINGS

DESCRIPTION OF THE PREFERRED EMBODIMENTS

The present invention will be described in more detail with reference to the accompanying drawings.

Figure 1:
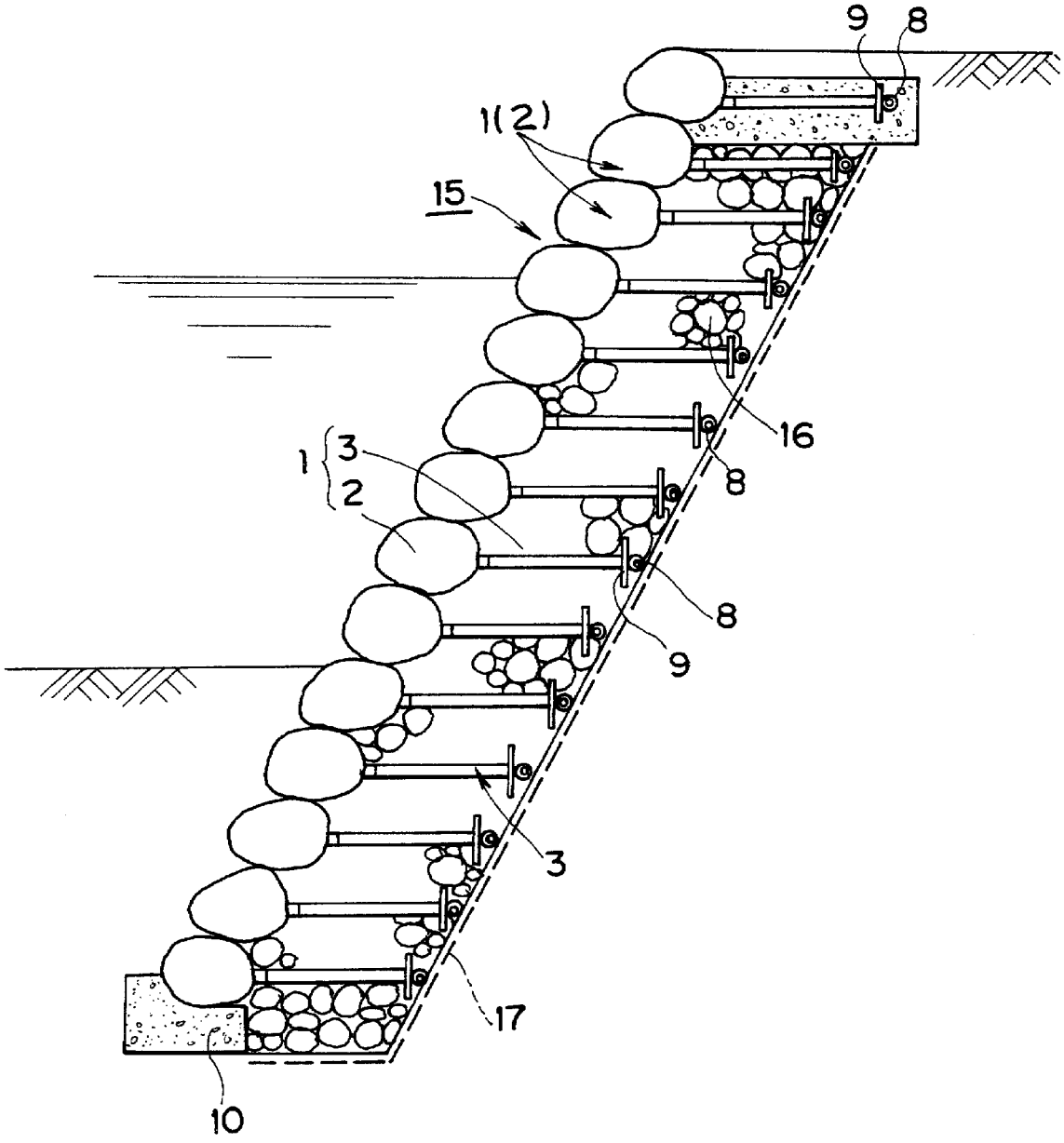
FIG. 1 is a schematic view for explaining a revetment to be built on a river bank according to an embodiment of the present invention.
Figure 2:
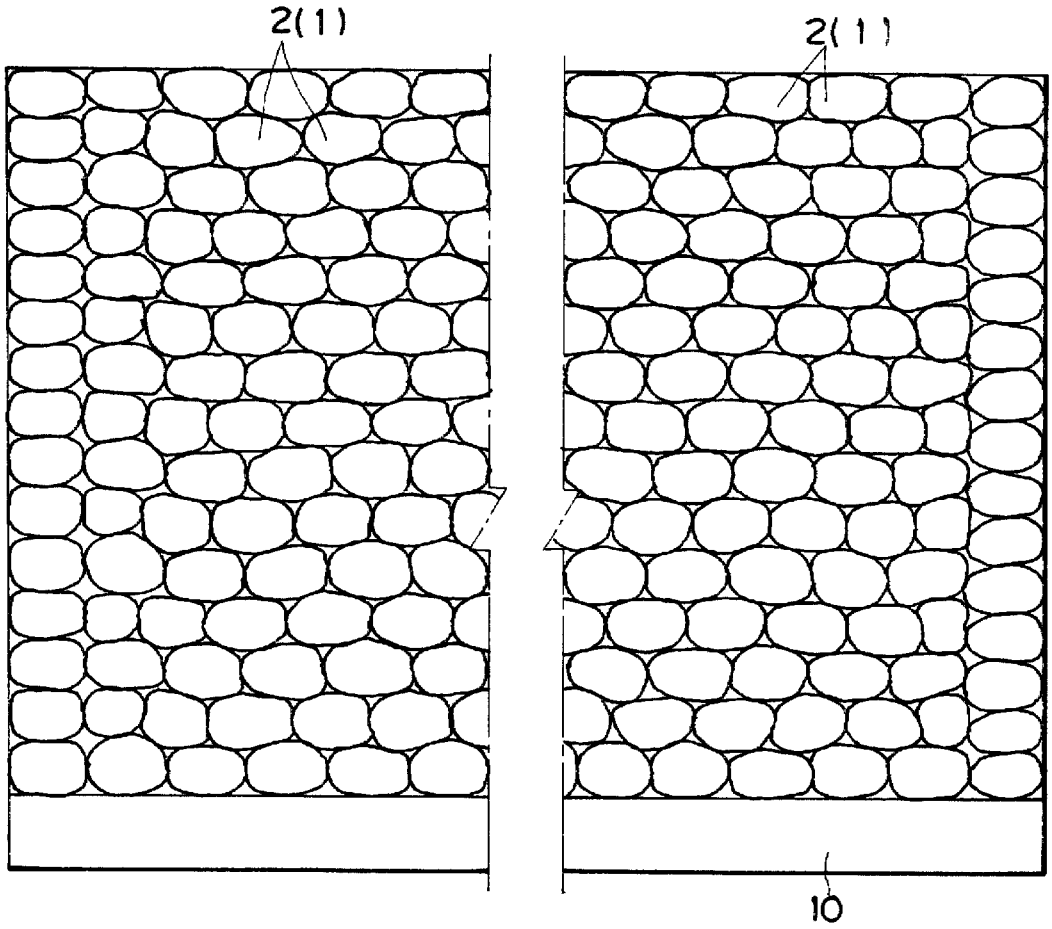
FIG. 2 is a front view of the revetment according to the embodiment of the present invention.

FIGS. 1 to 12 illustrate a construction according to an embodiment of the present invention. As shown in FIGS. 1 and 2, the first embodiment is directed to a revetment 15 for the protection of a river bank or the like as the construction which is made from a number of structural units 1.

The structural unit 1 is composed of a stone member 2 as a wall surface member for a construction for use in building the construction and an anchor 3.

The structural units 1 may be produced from stone members. The stone member 2 may be a round stone, a cracked stone, a cobbled stone or the like. The stone member 2 may preferably have a compressive strength of 30 $N/mm^2$ or higher, and the size of the stone members may be defined in accordance with the construction site on which the structural units are to be built into a construction. More specifically, the diameter of the stone member 2 may range preferably from 100 mm to 500 mm and more preferably approximately 300 mm. The kind and size of the stone member 2 may appropriately be chosen in accordance with the construction site.

Figure 6:
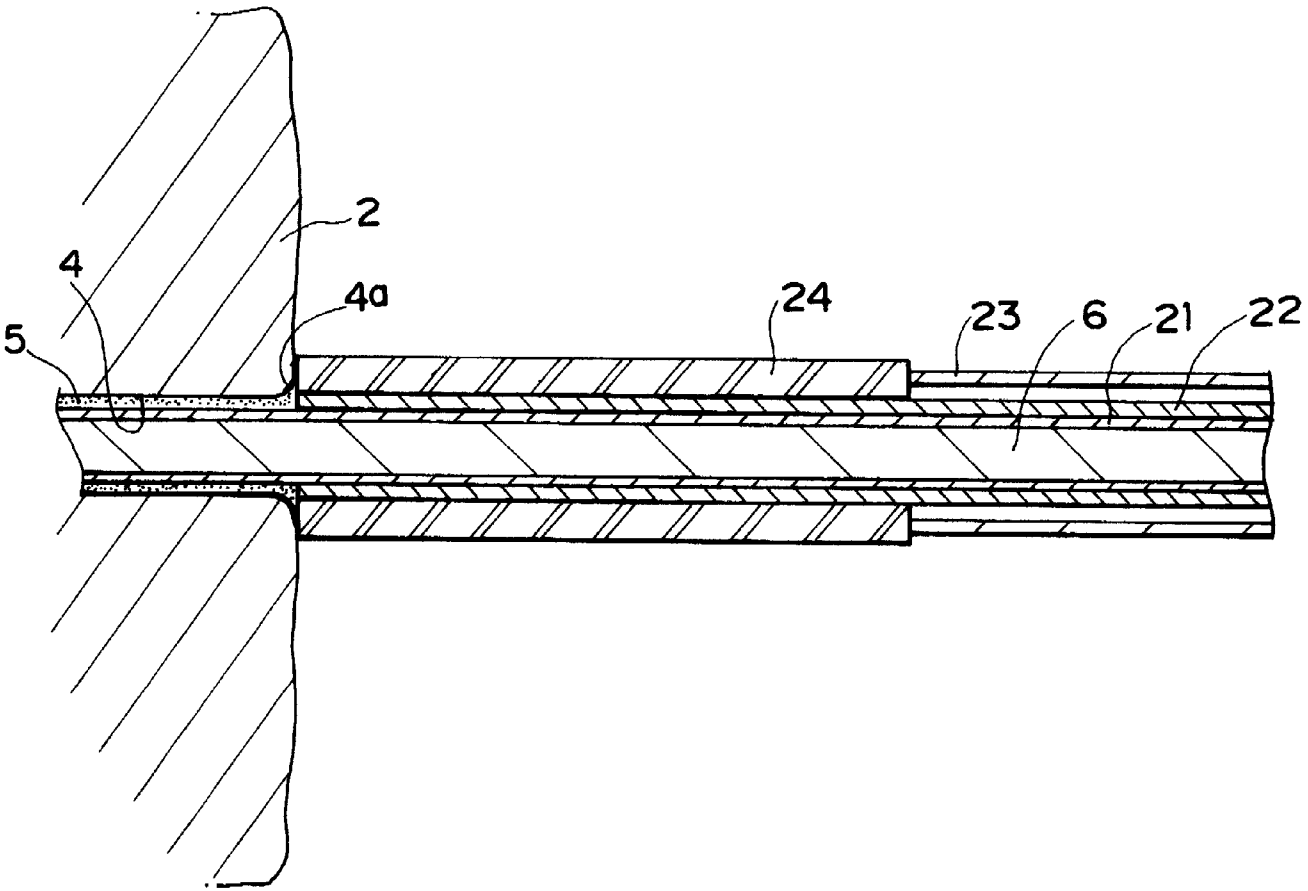
FIG. 6 is an enlarged sectional view showing the position of a stone member relative to the position of the anchor for use with the structural unit according to the embodiment of the present invention.

In this embodiment, the structural unit 1 may be structured in such a way that a stone members 1 is provided with a mounting cavity 4 (see FIG. 6). The mounting cavity 4 may be formed in the one side of the stone member 2 by usual conventional means such as a processing tool, e.g., a drill or the like, and the mounting cavity 4 may preferably be no through hole. The opening edge portion of the mounting cavity 4 may be beveled to form a beveled portion 4*a*.

Figure 3:
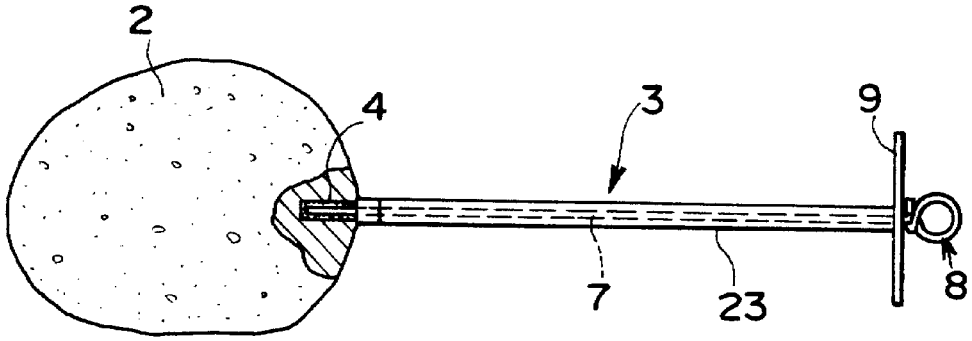
FIG. 3 is a schematic view for explaining a structural unit according to an embodiment of the present invention.

As shown in FIGS. 1 and 3, the anchor 3 is connected to the stone member 2 through the mounting cavity 4. The anchor 3 may comprise a bar member 7, a coiling portion 8 as a movement-regulating section, and a stopper panel 9. The coiling portion 8 and the stopper panel can prevent the stone members from falling down from the construction site such as a river bank side or the like.

Figure 4:
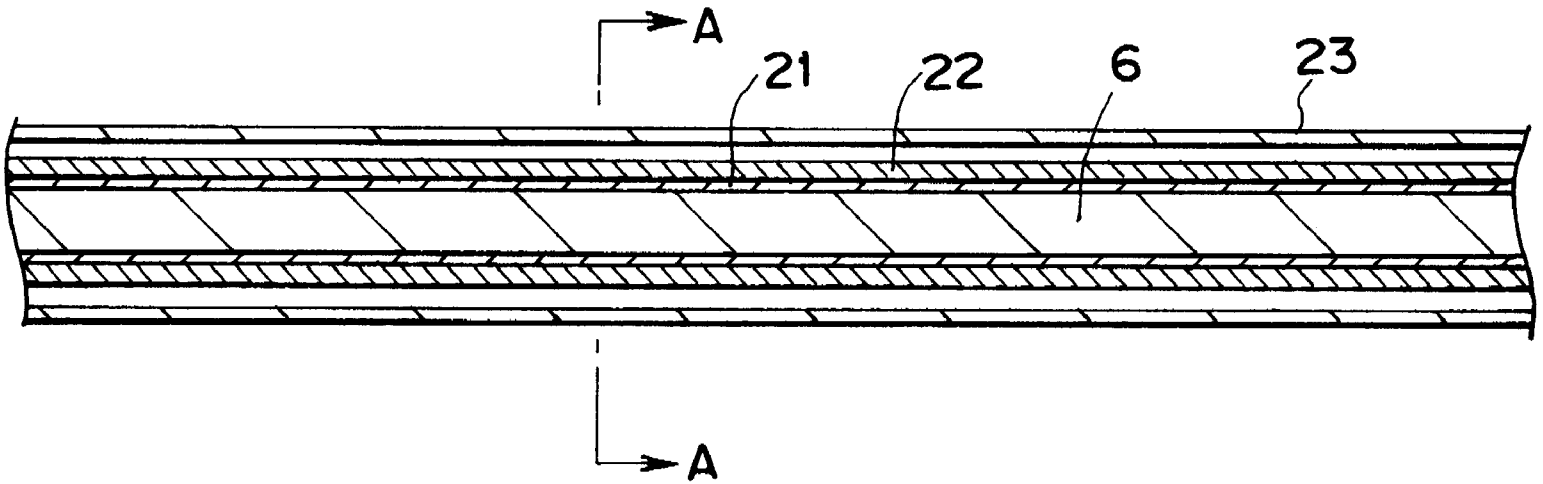
FIG. 4 is an enlarged longitudinal sectional view showing an anchor for use with the structural unit according to the embodiment of the present invention.
Figure 5:
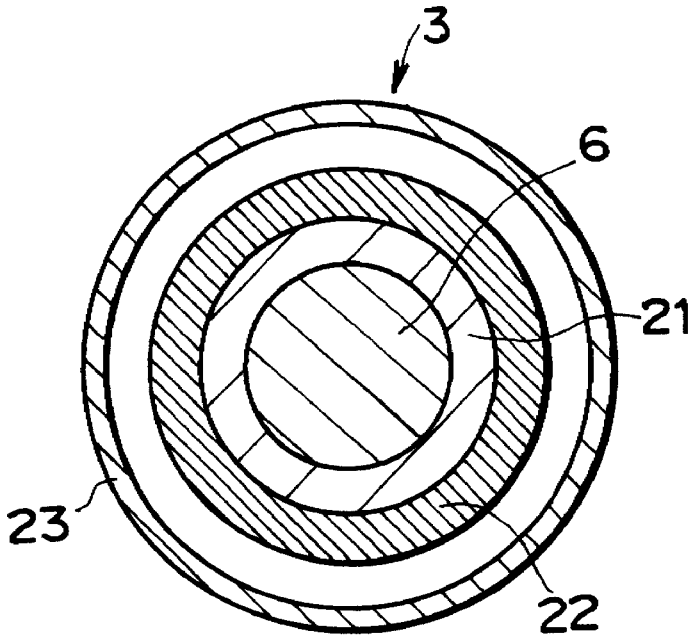
FIG. 5 is an enlarged sectional view as taken along line A—A in FIG. 4.
Figure 7:
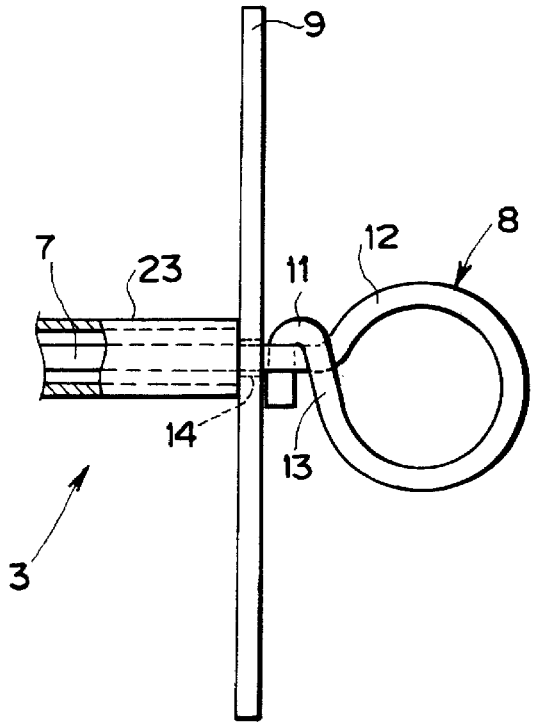
FIG. 7 is an enlarged sectional view showing a stopper panel, a coiled portion, and a protective tube member structuring the structural unit according to the embodiment of the present invention.

As shown in FIGS. 3, 4 and 7, the bar member 7 and the coiling portion 8 are integrally formed by a linear member 6 that may preferably be made from an iron wire, an iron rod or a steel tube with strength, processing performance and so on taken into account. In the embodiment of the present inventions it is preferred to use an iron wire (although it may contain approximately 10% aluminum) having a diameter of approximately 7 mm. On the outer periphery of the linear material 6, a covering resin layer 22 is formed as a first protective layer, in addition to a plated layer 21, in order to prevent the linear member from rusting. As the plated layer 21 it is preferred to use a zinc-aluminum alloy. In this embodiment, a zinc-aluminum alloy may preferably be plated at the plating rate of approximately 300 grams per square meter on the linear member 6. As the covering resin layer 22, it is preferred to use an olefinic resin. In this embodiment, a high-density polyethylene resin is preferred particularly from the viewpoint of rusting prevention. It is preferred to further coat the plated layer 21 with the high-density polyethylene resin at the coating rate of approximately 500 microns.

FIGS. 3 and 4 depicts the bar member 7 extending straight in a relatively elongated form in the range of from approximately 0.5 to 1.5 meters, preferably from approximately 0.5 to 0.8 meter. An one end portion of the anchor 3 (the right-hand side end portion in FIG. 4) is inserted into the mounting cavity 4 of the stone member 2 and it may be joined and fixed to the stone member 2 with adhesive 5 (e.g., adhesive of an epoxy resin type, see FIG. 6) or any other appropriate means. The one end portion of the bar member 7 (i.e., the portion inserted into the mounting cavity 4 of the stone member 2) may be provided with the plated layer 21, without the covering resin layer 22, in order to enhance the bonding between the one end portion of the bar member 7 and the adhesive 5. In this case, it is preferred to make the one end portion of the bar member 7 on the outer peripheral surface thereof uneven with the purpose to allow a tighter engagement of the bar member with the adhesive. As shown in FIG. 3, the opposite end portion of the bar member 7 extends away from the stone member 2 toward the construction site such as a river bank or the like.

As shown in FIGS. 1, 3 and 7, the bar member 7 is coiled at the opposite portion of the stone members to form a ring-shaped coiling portion 8. The ring-shaped part of the bar member 7 may be preferably as large as approximately 30 mm in inner diameter. The ring-shaped part of the bar member 7 may be in a circular form by coiling the bar member 7 and then wound round a beginning section 12 of the ring-shaped part as a wound portion 11, without being welded thereto. The coiling portion 8 may preferably be formed in a symmetrical shape so as to expand toward the both sides symmetrically with respect to the axis of the bar member 7. The wound portion 11 at the ending section 13 of the ring-shaped part of the coiling portion 8 may be wound on the beginning section 12 of the ring-shaped part thereof. In this case, the wound portion 11 may preferably be formed in a generally U-shaped manner and wound on the bar member 7 at the beginning section 12 thereof, without tight engagement with the bar member 7, particularly from the viewpoint of easy processing. The U-shaped wound portion 11 allows to move toward the axial direction of the bar member 7 by guidance with the aid of the bar member 7 as long as the wound portion 11 is not tightly engaged with the beginning section 12 of the coiling portion 8. Therefore, this configuration allows the wound portion 11 to abut with the beginning section 12 of the coiling portion 8 on the basis of the guidance effect on the wound portion 11 by the bar member 7 as an external force acts upon the wound portion 11 toward the coiling portion 8 and regulates a further movement of the wound portion 11. In order to achieve a smooth guidance and holding effects of the wound portion 11 by the aid of the bar member 7, the coiling portion 8 may be formed in plural number, that is, the bar member 7 may be coiled plural times to form a plurality of the wound portions.

Figure 8:
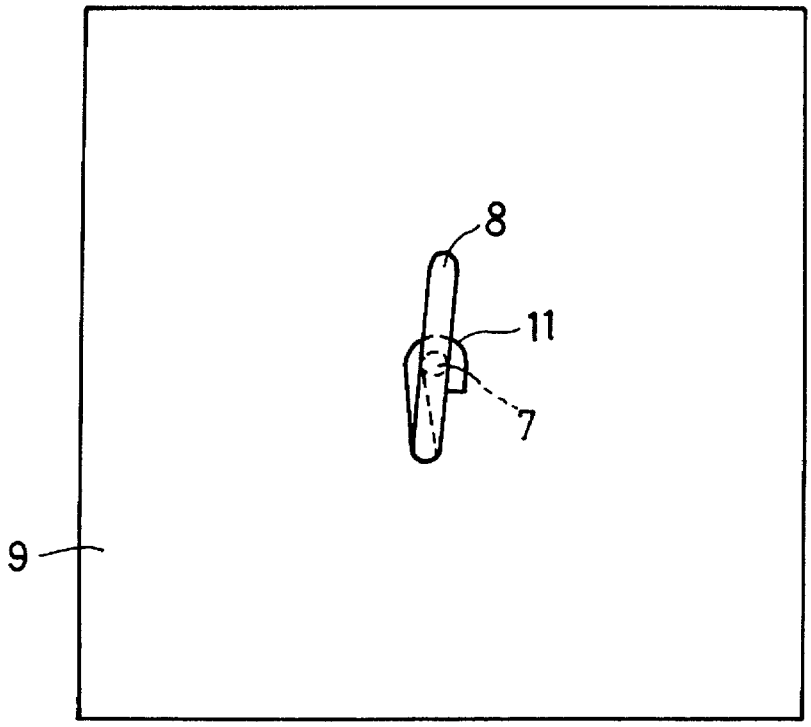
FIG. 8 is a right-handed side view of FIG. 7.

The stopper panel 9 may be held to the bar member 7 with the panel faces directed to the stone member 2 and the coiling portion 8, as shown in FIGS. 3, 7 and 8, so as to be movable along the bar member 7. The stopper panel 9 may preferably be made of a synthetic resin, such as ABS resin, or the like and be of a rectangular form having each side approximately 150 mm long and approximately 6 mm thick. It is provided with a hole 14 at its central portion, through which the bar member 7 penetrates and extends outwardly in both directions. The stopper panel 9 can be moved along the bar member 7 in both directions yet its movement is regulated by means of the coiling portion 8. As an external force is applied to the coiling portion 8 via the stopper panel 9, the outward movement of the stopper panel 9 is blocked and the stopper panel pushes the beginning section 12 of the coiling portion 8, unless the ring-shaped part of the coiling portion 8 would be flattened into a straight form. Therefore, the coiling portion 8 can effectively acts as a stopper, i.e., a movement-regulating means, for the stopper panel 9.

As shown in FIGS. 3 and 6, the bar member 7 may be provided with a protective tube member 23 functioning as a second protective layer and with a flexible tube member 23 functioning as a flexible layer on the outer periphery thereof over the length extending between the stopper panel 9 and the stone member 2. The protective tube member 23 is located on the side of the stopper panel 9 and the flexible tube member 24 is located on the side of the stone member 2. Further, the protective tube member 23 and the flexible tube member 24 are interposed between the stone member 2 and the stopper panel 9 (the coiling portion 8). This configuration of the protective tube member 23 and the flexible tube member 24 can protect exposure of the outer periphery of the bar member 7 to water and the outside.

The protective tube member 23 is disposed with the main object to protect the bar member 7 from the external force directly from the outside, particularly from an impact force upon filling the anchor etc. with filling materials 16 or the like as will be described hereinafter. Therefore, the protective tube member 23 covering a majority portion of the outer periphery of the bar member 7 can provide the anchor itself with rigid properties. For use in the embodiment of the present invention, the protective tube member 23 may preferably have an inner diameter a of approximately 8 mm, a length of approximately 440 mm, and a tube thickness of approximately 0.5 mm.

The flexible tube member 24 may be disposed with the major object to protect the bar member 7 and prevent the bar member 7 from breakage by physical damages imposed upon filling the anchor with the filling materials 16 or the like. In order to achieve this object, the flexible tube member 24 may preferably be disposed so as to separate the protective tube member 23 from the stone member 2 in a certain distance. In other words, the flexible tube member 24 may be interposed between the stone member 2 and the protective tube member 23, as indicated by the virtual line in FIG. 9. Further, the interposition of the flexible tube member 24 between the stone member 2 and the protective tube member 23 can reinforce the bar member 7 by the aid of a larger radius of curvature so as to become unlikely to break or otherwise damage by the filling materials 16 upon filling the anchor 3 with the filling materials. Moreover, for use in the embodiment of the present invention, the flexible tube member 24 may preferably be made of a soft tube member including rubber tube, coated paper tube, for example.

Figure 9:
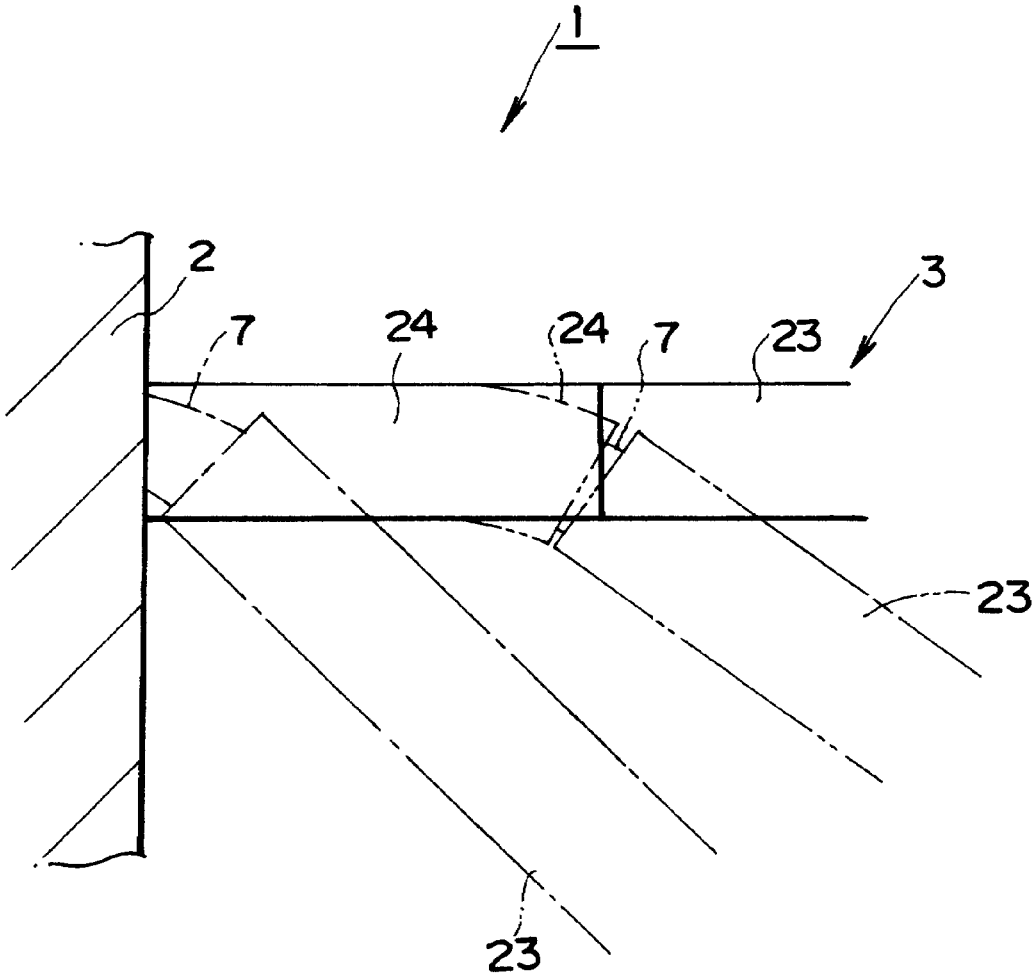
FIG. 9 is a view for explaining the action of a flexible tube member and a protective tube member on the bending of a linear member.

On the other hand, if the bar member 7 would be protected with a rigid tube such as an iron pipe or the like as the protective tube member 23, without using any flexible tube member, as indicated by chain line in FIG. 9, such a rigid protective member is not bent or curved so that the bar member 7 is not bent or curved, too, and sustains its original state, even if a bending moment would be applied to the anchor 3. However, if a bending moment being applied to the anchor would become larger, the protective tube member 23 may be caused to bent at the point of abutment with the stone member 2, while the protective tube member 23 composed of the rigid protective member is stayed as it is without being bent. As the bending moment then reaches nearly the maximal bending moment, the point of abutment of the protective tube member with the stone member 2 may break and the portion of the bar member 7 is exposed to the outside at the point of break, as indicated by a chain line in FIG. 9. In order to compete with this situation, it is preferred that the flexible tube member 24 be located in a certain distance from the stone member 2 and that the flexible tube member 24 be interposed between the protective tube member 23 and the stone member 2 in the configuration as described above.

More specifically, the flexible tube member 24 may preferably be set to be smaller in length than the diameter of the filling materials 16 to embed the anchor 3 therein. By setting the flexible tube member 24 in the full length shorter than the diameter of the filling material 16, the bar member 7 can be protected by the flexible tube member 24 from an impact of the filling materials 16 upon filling with the filling materials 16. In order to satisfy these requirements, it is preferred to set the full length of the flexible tube member 24 to be approximately 50 mm when it is taken into account that the diameter of the filling material 16 ranges from approximately 50 to 150 mm.

Then, the process for manufacturing the structural unit 1 for use in building the construction according to the present invention will be described with reference to the accompanying drawings.

Figure 10:
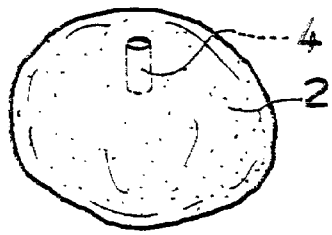
FIG. 10 is a view for explaining the step of preparing a structural unit according to an embodiment of the present invention.

As shown in FIG. 10, the stone member 2 is provided with the mounting cavity 4 at its middle portion by means of a processing jig such as a drill or the like. The mounting cavity 4 can achieve the properties to increase the area of adhesion of the anchor 3, i.e., the bar member 7, to the stone member 2 through adhesive and ensure an integral attachment of the anchor 3 to the stone members 2. Upon forming the mounting cavity 4, it is preferred to form the mounting cavity 4 by the processing jig, while the stone member 2 is held directing its surface upward for brevity of forming the mounting cavity.

Figure 11:
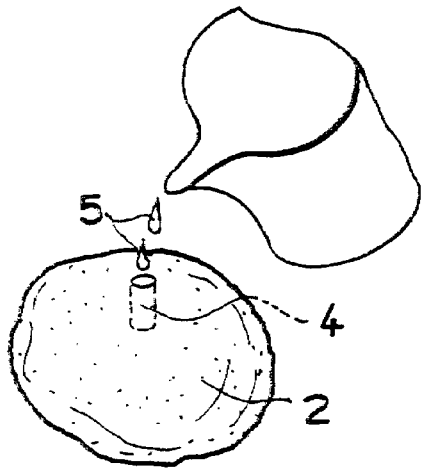
FIG. 11 is a view for explaining the steps of preparing the structural unit following the step of FIG. 10.

Then, as shown in FIG. 11, an adhesive 5 is poured into the mounting cavity 4 in a given amount sufficient to ensure the fixedly mounting of the anchor 3 to the stone member 2, while the surface of the stone member 2 with the cavity formed therein is directed upward for readily pouring the adhesive.

Figure 12:
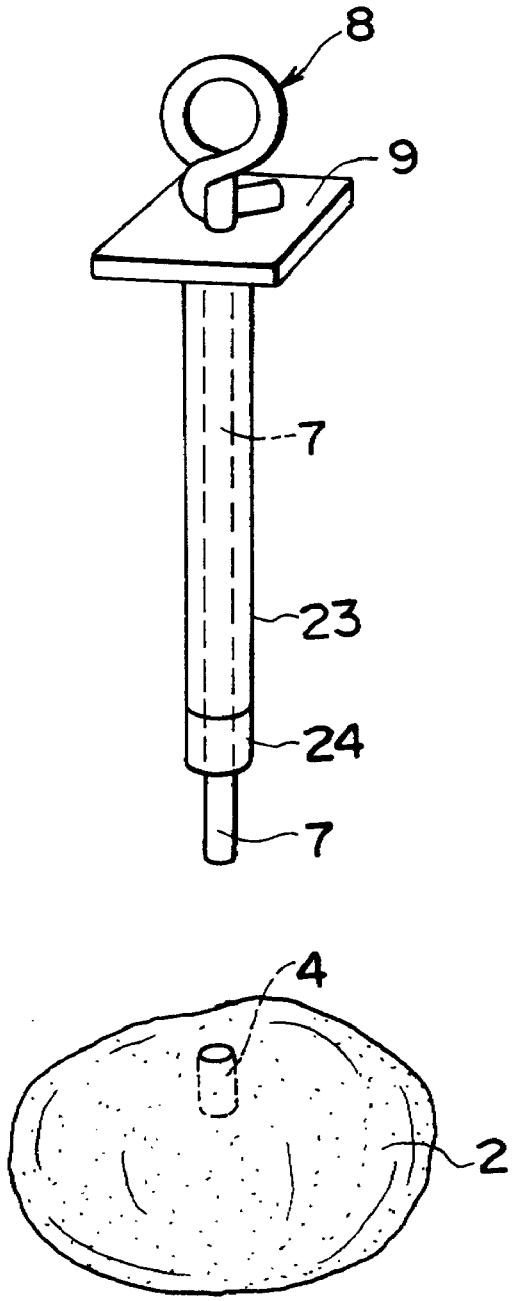
FIG. 12 is a view for explaining the steps of preparing the structural unit following the step of FIG. 11.

Further, as shown in FIG. 12, a one end portion of the bar member 7 is inserted into the mounting cavity 4 of the stone member 2 with the adhesive 5 poured therein in advance. As the adhesive 5 is allowed to cure, the bar member 7 is fixed securely and integrally to the stone member 2 by the aid of the adhesive 5. In this embodiment, it is preferred to insert the bar member 7 into the mounting cavity 4 while the adhesive 5 filled therein is still stayed in an uncured state, although the adhesive 5 may be poured into the mounting cavity 4 after the bar member 7 has been inserted therein. Moreover, it is preferred that the bar member 7 is installed with the protective tube member 23 and the flexible tube member 24 in the manner as described above, prior to the pouring of the adhesive into the cavity.

Upon inserting the bar member 7 into the mounting cavity 4 of the stone member 2, it is preferred that the one end portion of the bar member 7 be inserted into the cavity while it comes into contact with the peripheral edge portion of the mounting cavity 4 and it is being pressed onto the edge portion thereof. This way of inserting the bar member 7 into the cavity allows a tight mounting of the protective tube member 23 and the flexible tube member 24 on the bar member 7 between the stopper panel 9 and the stone member 2 by taking advantage of the repulsive force on the basis of the compression of the flexible tube member 24. This can protect the penetration of water or other liquid into a gap between the bar member 7 and the protective tube member 23 or the flexible tube member 24 and consequently the exposure of the bar member 7 to the water as well as it can protect the bar member 7 from the filling materials 16.

After the one end portion of the bar member 7 has been inserted into the mounting cavity 4 of the stone member 2, the adhesive 5 is allowed to stand and cure, thereby mounting the bar member 7 integrally on the stone member 2 and yielding a structural unit 1 for building the construction.

The structural units 1 as manufactured in the above manner may be assembled into a revetment 15 for example, as shown in FIGS. 1 and 2. The revetment 15 may be structured in such a way that the stone members 2 of the structural units 1 are laid on a concrete foundation 10 upwardly in a stepwise way with the anchors 3 directed in the same directions one after another toward the bank face of a river or the like. More specifically, the lowermost or bottom row of the structural units 1 is laid on the topside of the concrete foundation 10 with the stone members 2 facing beforehand and the anchors 3 disposed behind so as to allow the respective coiled portions 8 to come into abutment with the bank surface of the river or the like on which the revetment 15 or the like is being built. Then, the second bottom row of the structural units 1 is laid on the bottom row of the structural units in such a manner that the stone members 2 of the second bottom row are laid on the corresponding stone members 2 of the bottom row while the anchors 3 of the second bottom row are disposed above the anchors 3 of the bottom row in a stepwise way. Likewise, the structural units 1 of the upper row are laid on the structural units 1 of the immediately lower row in substantially the same manner as described above until the uppermost or top row of the structural units 1 is laid on the structural units 1 of the second top row and formed into the revetment 15.

Upon constructing the revetment 15 or the like, the structural units 1 of the upper row have been laid on the structural units 1 of the lower row, the filling materials 16 composed of natural stone, round stone, cracked stone, cobbled stone member or the like may be filled into a space between the structural units in the upper and lower rows, particularly between the anchors 3 and the stopper panel 9 thereof, and placed on the anchors 3 and the stopper panels 9 thereof, thereby providing a surface on which another row of the structural units 1 is to be laid. The embedding of the structural units 1 with the filling materials 16 and the flattening of the top surface of the filling materials can ensure the stability for laying another row of the structural units 1 on the lower row thereof and enable the smooth operations for laying them thereon. The structural units 1 of the top row are likewise laid on the structural units 1 of the second top row constructing the revetment 15 or the like and they are filled with the filling materials 16.

In other words, the structural units 1 may be laid in the manner as shown in FIG. 2 in the direction along the flow of a river or along the bank wall of a river or the like on which the revetment 15 or the like is to be constructed. Further, although the stone members 2 of the structural units 1 in an upper row are laid on the stone members 2 of the structural units in lower rows in a stepwise manner, the surface of the revetment 15 or the like can be said to be generally inclined at an identical angle along the bank wall surface of the river or the like.

Furthermore, the filling materials 16 may be preferably filled in a space between the anchors 3 of the structural units 1 in the upper row and the anchors 3 thereof in the lower row after the upper row of the structural units has been laid on the lower row of the structural units, in order to ensure the stability of the construction. As the structural units 1 have been assembled into the revetment 15 or other constructions, the filling materials 16 are laid over the anchors 3 and the stopper panels 9 of the structural units for the construction.

Moreover, as the structural units 1 are laid over one another with the stone members 2 facing the flow of a river or the like, there are gaps among the stone members 2 next one another, so that the gaps can provide spaces for the habitation and growth of aquatic livings such as fish, shells, aquatic plants, and so on. In addition, the filling of the spaces among the anchors 3 and the bar members 7 of the structural units 1 of the upper and lower rows can provide the filling materials 16 with resistance to sliding or falling into the river or the like due to the engagement of the plate face of the stopper plate with the filling materials 16. Further, they can enhance the ability of holding the anchors 3 and prevent the sliding or falling of the stone members 2 down into the river or the like. Moreover, the protective tube member 23 and the like can protect the anchors 3 from the filling materials 16.

Upon building the revetment 15 or any other like constructions by laying the structural units 1 in plural rows and filling the spaces between the anchors 3 and the bar members 7 in the upper and lower rows with the filling materials 16, it is preferred to apply pressure from the outside to the filling materials 16 by padding the filling materials 16 with a roller or any other appropriate pressing means, in order to enhance the density of the filling materials 15 and consequently prevent the stone members 2 from sliding away and falling down from the revetment 15 or the like. This can assist in providing the filling materials 16 as well as the anchors 3 and the stopper panels 9 with resistance, including the resistance to the movement of the stopper panel 9. In FIG. 1, reference numeral 17 denotes a preventive sheet that can prevent the sliding or falling of sand, earth or other filling materials.

The structural units 1 are built into the revetment 15 or any appropriate like constructions in substantially the same manner as described above, as shown in FIGS. 1 and 2. For the revetment 15 or the like, the stone members 2 of the structural units 1 form a wall surface as a protective wall. Moreover, the wall of the revetment is rigid yet it can provide aquatic livings such as fish, aquatic plants or the like with a living environment.

Figure 13:
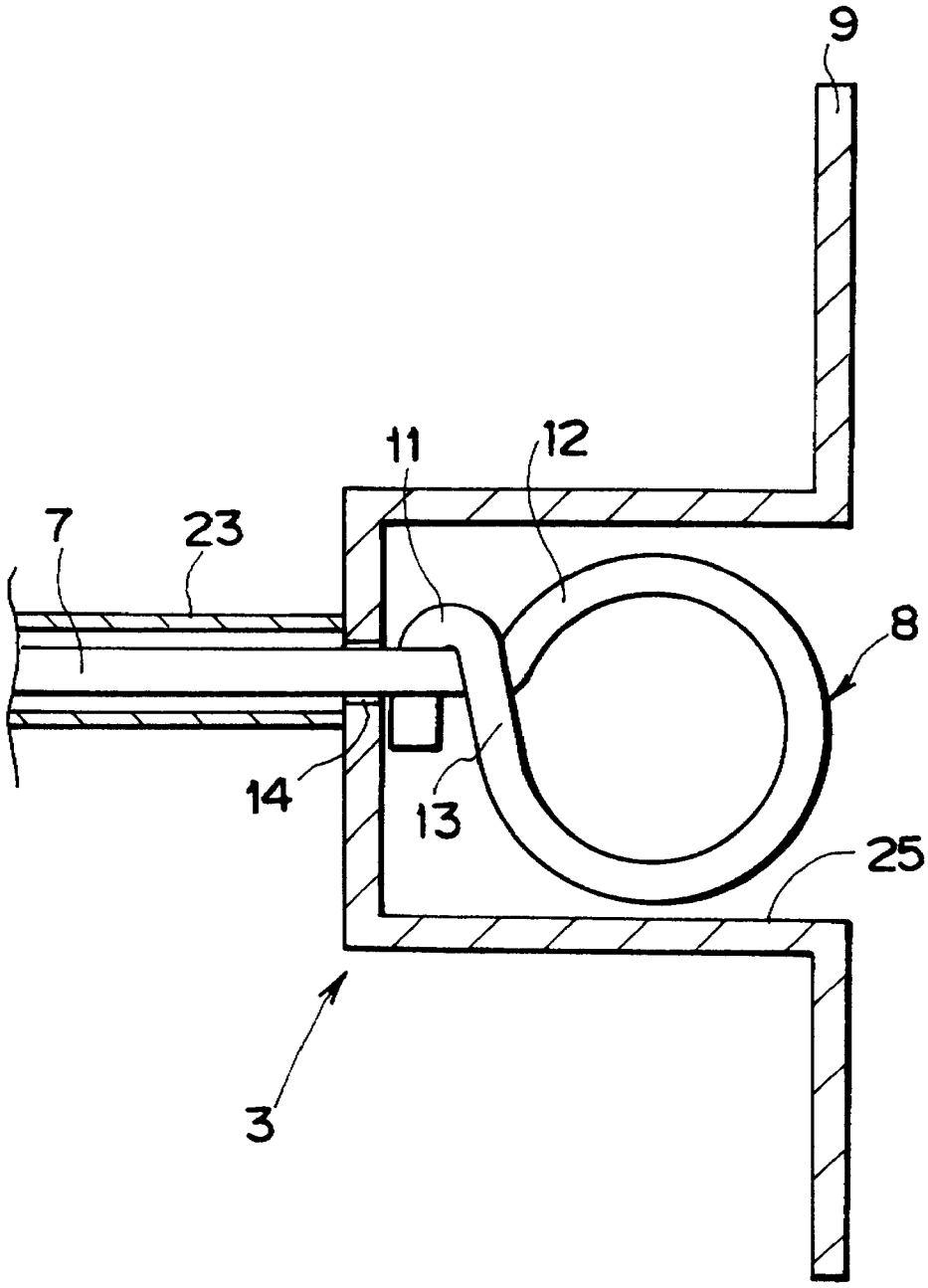
FIG. 13 is a partially enlarged view for explaining a structural unit according to another embodiment of the present invention.

FIG. 13 shows the second embodiment of the present invention which in turn is directed to a variation in the stopper panel 9. In the embodiment as shown in FIG. 13, the stopper panel 9 is formed into a projecting section 25 in a box-like shape as an accommodating section at the middle portion thereof. The projection section 25 is disposed projecting toward the side of the stone member 2, and the coiling portion 8 is disposed within a space of the projection section 25, as shown in FIG. 13. This configuration of the projection section 25 can protect the coiling portion 8 and the stopper panel 9 from the filling materials 16 upon filling with the filling materials. Moreover, this can prevent the coiling portion 8 and the stopper panel 9 from rusting in a sure fashion due to damages of the coiling portion 8 caused by the filling materials 16 upon filling with the filling materials.

Although the present invention has been described regarding the embodiments of the present invention, it is to be noted herein that the present invention is not interpreted as being limited to the above embodiments in any respect and it encompasses any modifications and variations without departing the scope and spirit of the invention. Examples of the modifications and variations may include the following modes.

It is to be understood herein that the stone member 2 is not restricted to a natural stone and its processed stone and that it may include any artificial stone member such as a stone reproduced from waste plastic material, waste asphalt material or fly ash, a concrete block, e.g., an artificial stone or an artificial wood, any appropriate wooden material in combination with a stone, or an accommodating container, e.g., a vat for plantation, It is also to be understood herein that the one end portion of the anchor 3 may be bent at the maximal angle of 45° or less with respect to the remaining portion thereof by utilizing the unlikelihood of the one end portion of the anchor 3 to break due to a large radius of curvature, if adjustment for the seating of the stone members 2 is required upon laying the stone members 2 of the structural units 1 on one another.

Further, the anchor 3 may be formed integrally with the stone member 2 by engagement of the anchor 3 with a nut fixed in the mounting cavity 4 of the stone member 2 while the anchor 3 is provided with a thread portion at its one end.

The anchor 3 may be mounted on a wall surface member 2 for the construction for a construction with the aid of a metallic or plastic expansion anchor, in place of adhesive 5.

The coiling portion 8 may be in a non-circular form such as an oval form or a rectangular form, as well as in a circular form.

It is further to be understood herein that the one end portion of the anchor 3 acting as the mounting end portion for mounting on the wall surface member 2 for the construction for the construction may be mounted indirectly on the wall surface member 2 for the construction therefor as well as directly thereon. For this purpose, for instance, the wall surface member 2 for the construction may be provided with a connecting tool through which the anchor 3 is connected to the wall surface member 2 for the construction.

A variety of plate members such as a concrete plate member or an iron plate member may be used for the stopper panel 9.

Moreover, it is to be understood herein that concrete waste materials may also be used as the filling materials 16, in addition to stones, including natural stones, cracked stones, etc.

Furthermore, the construction may include a retaining wall or the like, as well as the revetment.

In addition, it is understood herein that an iron wire or an iron net or any other appropriate material as a means for increasing the resistance of the structural unit 1 for building the construction may also be embedded so as to become erect or upright and the other end portion of the anchor 3 (i.e., the coiling portion 8) is connected to the iron wire or the iron net embedded. It is preferred in this case that the bottom portion of the iron wire or the iron net may be fixed by embedding it in the concrete foundation 10.

It is to be understood that the present invention is not interpreted as being limited in any respect to the embodiments as described above and it encompasses any appropriate modifications or variations without departing from the scope and spirit of the invention.

What is claimed is:

1. A structural unit for a construction comprising:

a wall surface member for the construction;

an anchor for use with the wall surface member; and a resistance-increasing member, wherein a first end portion of said anchor is mounted on said wall surface member for said construction so as to become apart from a second end portion of said anchor for use with the wall surface member, said resistance-increasing member is mounted on the second end portion of said anchor, said anchor for use with the wall surface member includes a protective layer assembly disposed at an outer periphery of said anchor, said protective layer assembly comprises a protective layer for ensuring protection against penetration of water and a protective member for resisting an external force at an outer periphery side of the protective layer, said protective layer is made of a resilient material so as to conform to deformation of the anchor, and said protective member is made of a rigid material, which covers the protective layer except for the portion of the protective layer adjacent to the wall surface member.

2. The structural unit as claimed in claim 1, wherein:

said protective layer comprises a resin-covered layer covered with a polyethylene resin; and said protective member comprises an iron pipe.

3. The structural unit as claimed in claim 1, wherein:

said resistance-increasing member comprises a stopper panel, made of a synthetic resin, inserted through an outer periphery of said first protective layer so as to be movable and a movement-regulating section for regulating the movement of said stopper panel outward an opposite end portion of said anchor for use with the wall surface member, said movement-regulating section therefore being disposed at the opposite end portion of said anchor therefore;

said protective member is disposed at the side of said wall surface member for the construction closer than said stopper panel; and said stopper panel is provided with an accommodation section for accommodating a periphery of said movement-regulating section with said anchor for use with the wall surface member centered.

4. The structural unit as claimed in claim 1, wherein:

said wall surface member for the construction is provided with a mounting opening for mounting said anchor for use with the wall surface member for the construction, and a beveled section is provided at a peripheral opening edge portion of said mounting opening so as to prevent said anchor from colliding with said peripheral opening edge portion of said mounting opening.

5. A structural unit for a construction comprising:

a wall surface member for the construction;

an anchor for use with the wall surface member; and a resistance-increasing member, wherein a first end portion of said anchor is mounted on said wall surface member for said construction so as to become apart from a second end portion of said anchor for use with the wall surface member, said resistance-increasing member is mounted on the second end portion of said anchor, said anchor for use with the wall surface member includes a protective layer assembly disposed at an outer periphery of said anchor, said protective layer assembly comprises a protective layer for protecting against water penetration, and a protective member for withstanding an external force at an outer periphery side of the protective layer, a flexible member is disposed in a series with said protective member at the outer periphery of said anchor for use with the wall surface member and interposed between the protective member and a side of said wall surface member for the construction, and a first end surface of said flexible member is disposed in abutment with said wall surface member for the constriction and a second end surface of said flexible member is disposed in abutment with an end surface of said protective member.

6. The structural unit as claimed in claim 5, wherein:

said flexible member is located within a length from said wall surface member for the construction, the length being shorter than a diameter of a filling material for embedding said anchor for use with the wall surface member.

7. The structural unit as claimed in claim 6, wherein:

said flexible member and said protective member are interposed in a series between said resistance-increasing member and said wall surface member for the construction.

8. A construction comprising a plurality of structural units for the construction, each structural unit including a resistance-increasing member for increasing a resistance mounted at a first end portion of an anchor for use with a wall surface member for the construction, said anchor being mounted at a second end portion of the anchor on said wall surface member, said plurality of structural units being laid on one another in said construction so as to be disposed adjacent to one another, and said anchor and said resistance-increasing member being embedded with a filling material in said structural unit for the construction, wherein said anchor for use with the wall surface member includes a protective layer assembly disposed at an outer periphery of said anchor, and said protective layer assembly comprises a protective layer for protecting against penetration of water and a protective member for resisting an external force at an outer periphery side of the first protective layer, said protective layer of each of the structural units is made of a resilient material so as to conform to deformation of the anchor, and said protective member of each of the structural units is made of a rigid material, which covers the protective layer of the corresponding structural unit except for the portion of the protective layer adjacent to the wall surface member.

9. The construction as claimed in claim 8, wherein further comprising:

a flexible member, which is disposed in a series with said protective member at the outer periphery of said anchor for use with the wall surface member and interposed between said protective member and said wall surface member for the construction, and said flexible member is located at a side of said wall surface member for the construction and disposed in abutment with said wall surface member therefore.

10. A method for the production of a structural unit for construction, comprising:

preparing a wall surface member for the construction with a mounting cavity, a linear member having a first end portion functioning as a mounting end portion for mounting said wall surface member and having a second end portion with a resistance-increasing member for increasing resistance, said linear member being covered with a protective layer for protecting against water penetration, and a protective tube member in a cylindrical form, said protective layer being made of a resilient material so as to conform to deformation of the linear member, and said protective tube member being made of a rigid material;

inserting said linear member into said protective tube member from the first end of said linear member and projecting a portion of said linear member from said protective member and thereby, the protective tube member covers the protective layer except for the portion of the protective layer adjacent to the wall surface member; and filling the mounting cavity of said wall surface member for the construction with adhesive and inserting said liner member protruded from said protective tube member into the mounting cavity.

11. The method for the production of a structural unit for a construction as claimed in claim 10, further comprising:

preparing a flexible tube member;

inserting the liner member into the protective tube member and the flexible member from the first end portion of the liner member and projecting a portion of the linear member from the flexible tube member; and filling the mounting cavity of the wall surface member for the construction with adhesive and inserting the linear member protruded from the flexible tube member into the mounting cavity thereof.

12. A method for the production of a structural unit for a construction, comprising:

the step of preparing a wall surface member for the construction with a mounting cavity, a liner member having a one end portion functioning as a mounting end portion for mounting said wall surface member therefore and having the other end portion with a resistance-increasing member for increasing resistance, a protective tube member in a cylindrical form for withstanding an external force at an outer periphery side of the linear member, a flexible tube member in a cylindrical form, and a protective layer covering the outer periphery of said linear member to protect against water penetration;

the step of inserting said linear member into said protective tube member and said flexible tube member from a one end of said linear member and projecting a portion of said linear member from said flexible tube member; and the step of filling the mounting cavity of said wall surface member for the construction with adhesive and inserting said linear member protruded from said flexible tube member into the mounting cavity thereof, so that a first end surface of said flexible member is disposed in abutment with said wall surface member for the construction with a mounting cavity and a second end surface of said flexible member is disposed in abutment with an end surface of said protective tube member.

13. A construction comprising a plurality of structural units for the construction, each structural unit including an anchor for use with a wall surface member of the construction, a resistance-increasing member for increasing a resistance mounted at a first end portion of the anchor for use with a wall surface member for the construction, the anchor being mounted at a second end portion of the anchor on the wall surface member, the plurality of structural units being laid on one another in said construction so as to be disposed adjacent to one another, and the anchor and the resistance-increasing member being embedded with a filling material in the structural unit for the construction, wherein:

the anchor for use with the wall surface member is provided with a protective layer assembly disposed at an outer periphery thereof, said protective layer assembly comprises a protective layer for protecting against water penetration and a protective member for withstanding an external force at an outer periphery side of the protective layer, a flexible member is disposed in series with the protective member at the outer periphery of the anchor for use with the wall surface member, the flexible member is interposed between the protective member and a side of the wall surface member for the construction, and a first end surface of the flexible member is disposed in abutment with the wall surface member for the construction and a second end surface of the flexible member is disposed in abutment with an end surface of the protective member.

14. A structural unit for a construction comprising a plurality of structural units for the construction, each structural unit including an anchor for use with a wall surface member for the construction, a resistance-increasing member for increasing a resistance, mounted at a first end portion of the anchor for use with a wall surface member for the construction, the anchor being mounted at a second end portion of the anchor on the wall surface member, the plurality of structural units being laid on one another in the construction so as to be disposed adjacent to one another, and the anchor and the resistance-increasing member being embedded with a filling material in the structural unit for the construction, the anchor for use with the wall surface member is provided with a protective layer assembly at an outer periphery thereof, the protective layer assembly comprising a protective layer for protecting against water penetration and a protective member for resisting an external force at an outer periphery side of the protective layer, the wall surface member for the construction is provided with a mounting opening for mounting the anchor for use with the wall surface member for the construction, and a beveled section is provided at a peripheral opening edge portion of the mounting opening so as to prevent the anchor from colliding with the peripheral opening edge portion of the mounting opening, wherein a flexible member is disposed in series with the protective layer at the outer periphery of the anchor for use with the wall surface member and is interposed between the protective member and the wall surface member for the construction; and the flexible member is located at a side of the wall surface member for the construction and is disposed in abutment with the wall surface member.

* * * * *